US006344101B1

(12) United States Patent
Graf

(10) Patent No.: US 6,344,101 B1
(45) Date of Patent: Feb. 5, 2002

(54) METHOD FOR PRODUCING BOARDS OF WOOD-BASED MATERIALS WITH STRUCTURED AND SMOOTH SURFACES USING A CONTINUOUSLY OPERATING EMBOSSING PRESS

(75) Inventor: Matthias Graf, Eppingen (DE)

(73) Assignee: Maschinfabrik J. Dieffenbacher GmbH & Co., Eppingen (DE)

( * ) Notice: Subject to any disclaimer, the term of this patent is extended or adjusted under 35 U.S.C. 154(b) by 0 days.

(21) Appl. No.: 09/373,707

(22) Filed: Aug. 13, 1999

(30) Foreign Application Priority Data

Aug. 13, 1998 (DE) ..... 198 36 823

(51) Int. Cl.[7] ..... B27N 3/24; B27N 3/26

(52) U.S. Cl. ..... 156/220; 156/311; 156/312; 156/580; 264/119; 264/120; 264/220

(58) Field of Search ..... 156/62.2, 311, 156/312, 209, 219, 220, 580; 264/119, 120, 220

(56) References Cited

U.S. PATENT DOCUMENTS 4,007,076 A 2/1977 Clark et al.

FOREIGN PATENT DOCUMENTS

DE 29507951 A1 * 6/1981
DE A1 197 18 771 11/1998
DE 198 36 742 A1 * 2/2000
JP 10-202628 * 4/1998

* cited by examiner

*Primary Examiner*—Sam Chuan Yao
(74) *Attorney, Agent, or Firm*—Foley & Lardner

(57) ABSTRACT

A process and plant for producing boards of wood-based materials having either a structured upper surface or a smooth upper surface. The plant has a continuously operating production press and a continuously operating embossing press. A discharge section and a transfer section are located between the continuously operating production press and embossing press. The continuously operating production press compresses and cures a mat of pressing stock to create a board that retains heat, while the continuously operating embossing press imparts the permanent embossed pattern on an upper surface of a board. The transfer section has a water spray device and a covered steam hood for cooling the board and producing steam. The cooled board is then accepted by the continuously operating embossing press which has an embossing pressure section having a steam-pressure build-up section, a steam-pressure plasticizing section, a high-pressure embossing section, and a drying and structure-fixing section for forming the embossed board. Disabling the sections of the continuously operating embossing press creates a board with a smooth upper surface. The transition of the board during the disabled period is numerically recorded in order to provide a flying changeover rate when switching between production of structured surface boards and smooth surface boards.

9 Claims, 3 Drawing Sheets

METHOD FOR PRODUCING BOARDS OF WOOD-BASED MATERIALS WITH STRUCTURED AND SMOOTH SURFACES USING A CONTINUOUSLY OPERATING EMBOSSING PRESS

BACKGROUND OF THE INVENTION

The invention relates to a method for producing boards of wood-based materials with structured surfaces as well as smooth surfaces, such as particle boards/fiber boards and chipboards and also synthetic boards comprising a combined component of wood and plastic or composed of plastic with and without reinforcing layers with structured surfaces, as well as a plant and a continuously operating embossing press for carrying out the method.

A method and plant of this kind are disclosed in DE-P 197 18 771.4. The object of that patent application is to produce boards of wood-based materials with or without an interruption in production, the mechanical strength properties of the finished boards and adhesive strength on the structured side being unimpaired.

The solution specified for the method is that the board of wood-based material just finished and released from the pressing operation is sprayed with water on one or both surfaces, after which it passes through a heated steam treatment section and is then subjected to a structuring process.

The plant for carrying out the method according to claim 6 of DE 197 18 771.6 for a continuous process consists in that a water spray device, followed by a heatable or unheated steam hood and then a structuring roll frame designed for one or both surfaces are arranged transversely across one or both surfaces immediately after the point where the board of wood-based material emerges from the press for a continuous process.

However, the method and plant in this prior application do not reveal or indicate any way by which process parameters for pressure and heat are to be used and, if required, in what time sequence the embossing pressure and heat input are to be used and how a plant and, where applicable, embossing press suitable for this must be embodied. In the case of a continuous process, it is namely not possible to introduce a structure by means of an embossing device without suitable and coordinated surface dampening and a subsequent appropriate plasticization process. This means that if the embossing pressure is not suitable and the internal temperature and moisture content of the boards is not sufficient, it is not possible to achieve adequate long-term pattern accuracy from the mechanically applied embossing pressure on the cover layers. Even after a prolonged embossing time, for example about 15–20 seconds, and at an embossing pressure of 7 $N/mm^2$, the embossed particle/fiber structures spring back into the state of a smooth surface, i.e. the embossed pattern disappears as soon as it leaves the embossing zone that imposed the structure.

Swiss Patent 614 666(=U.S. Pat. No. 4,007,076) has disclosed a method for embossing a synthetically produced board, primarily a hardboard. Here, water is applied to the surface of a cold board. However, this results in long process times because the water first has to be raised to the vaporization temperature. The quantity of surface water used, 54 $g/m^2$, is too low for the boards to be embossed in accordance with the present application to ensure sufficient plasticization in a short time. The inadequate surface moisture requires excessive pressures and an over-long total pressing time for permanent pattern accuracy of the embossed structure. Overall, this method does not provide any suggestion or impetus as to how permanent structuring of a board that has just emerged from the production press and is still hot is to be performed.

SUMMARY OF THE INVENTION

An object of the present invention is to indicate a method and create a plant with a continuously operating embossing press for imparting a permanent structure to the surfaces of a still hot board after it leaves a production press.

Another object of the present invention is to create board production plants operating to create both boards with and without structured surfaces.

A further object is to provide a flying changeover during the transition from a smooth to a structured surface, without the production of reject finished boards and without trimming waste, i.e., waste caused by cutting out sections of lower surface quality, and in small batch sizes for order-based production quantities.

Still another object is to create a means of controlling the production process so that there is no transition zone with an undefined surface quality between the smooth and the structured section of the board.

Another object of the present invention is to control a transition-free selection of the surfaces virtually on a numerically recorded line and with on-line production changeovers being technically possible.

Further advantageous measures and configurations of the subject matter of the invention will become apparent from the following description together with the drawings.

DETAILED DESCRIPTION OF PREFERRED EMBODIMENTS

Figure 1:
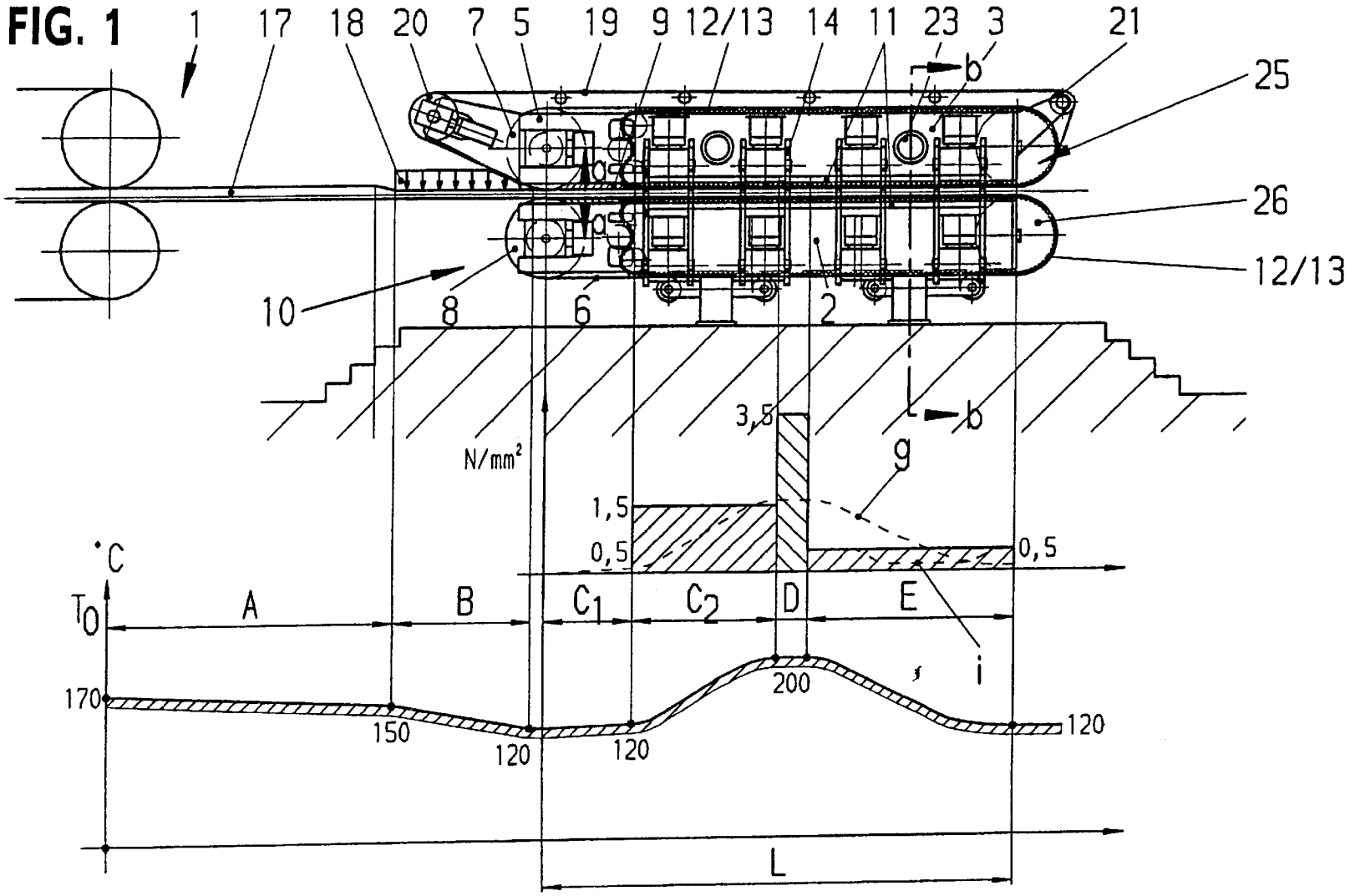
FIG. 1 shows the side view of the continuously operating embossing press according to the invention.

The teaching of the method according to the invention, and tests have confirmed this in the production of OSB boards, is that permanent introduction of a structure into the surfaces of boards of wood-based materials is possible only using the heat stored in the board immediately after it leaves the continuously operating press and only after applying additional surface water and subsequent plasticization of the cover layers using the process parameters according to the invention. That is, the successive process steps lead to a process of plasticization in the cover layers of the board that is necessary for the structuring operation and, after the board leaves the embossing zone that imposes the structure, to a lasting, unchanged embossed structure.

Another advantage is that, by virtue of convective heat input into the board in the steam pressure section C, in the heatable inlet to the continuously operating embossing press 10, the moisture applied to the surface of the board in the transfer section B with water spray application leads to the production of steam and to a steam-pressure build-up at the surface of the board, the necessary plasticizing of the cover layer of the board in the steam-pressure plasticizing section $C_2$ thereby being promoted and intensified.

For example, after the board moves through a short discharge section A, the still hot board just produced and released from the pressing operation is passed into a covered transfer section B, where its upward-facing surface is sprayed with water at a rate in a range of from 112.5°g/m$^2$ to 225 g/m$^2$, whereby the upper cover layer is cooled. The board is then accepted by a continuously operating embossing press 10 with a structured belt 19 revolving around the press ram 3, with contact being made with the surface of the board, and a steam pressure rising to about 0.5 N/mm$^2$ is built up in a steam-pressure build-up section $C_1$. A steam-pressure plasticizing section $C_2$ then follows within the pressing section L of the continuously operating embossing press 10, in which the board is subjected to an increasing embossing pressure up to 3.5 N/mm$^2$ to 4 N/mm$^2$ and a rising temperature up to 200° Celsius and this embossing pressure and this plasticizing temperature are maintained in a high-pressure and embossing section D and the board then continues on through the continuously operating embossing press 10, passing through a drying and structure-fixing section E under a falling embossing pressure down to about 0.5 N/mm$^2$ and a falling temperature down to about 120° Celsius until it reaches the end of the embossing section L, the time that the board takes to pass through the structuring system comprising the five process sections B, $C_1$, $C_2$, D and E being sufficient to form the embossed pattern permanently in the cover layer of the board.

Further, the processes in both presses are matched to one another in synchronism in such a way that, in one case, the continuously operating production press 1 operates alone to give a board with smooth surfaces and, in a second case and alternately for a structured surface, both presses, that is also the continuously operating embossing press 10, are in operation, the five process sections for the production of a structured board being taken out of operation by first of all switching off the application of water spray in the transfer section B, the transition line from a wet to a dry board surface being recorded numerically as it passes through and, as this transition line continues through, the upper compression plates 11 of the steam-pressure build-up zone $C_1$, the steam-pressure plasticizing section $C_2$, the high-pressure embossing section D and the drying and structure-fixing section E are depressurized numerically and raised out of contact with the board, and in that the continuously operating embossing press 10 is switched back from smooth boards to structured boards by first of all switching on the application of water spray in the transfer section B, the transition line from a dry to a wet surface being recorded numerically and the following four process sections, namely the steam-pressure build-up zone $C_1$, the steam-pressure plasticizing section $C_2$, the high-pressure embossing section D and the drying and structure-fixing section E being introduced accordingly.

According to the invention, the plant for carrying out the method consists in that immediately after the point where the board emerges from the continuously operating production press, there is a continuously operating embossing press for the upward-facing surface, a discharge section A with a transfer section B is provided between the two presses, the transfer section B is designed as a water spray device with a covered steam hood 18 and this is followed directly, via a sloping inlet region, by a continuously operating embossing press containing the embossing section L, the embossing section L having four processing zones in which the action of the temperature and embossing pressure differs, namely:

a steam-pressure build-up section $C_1$, a steam-pressure plasticizing Section $C_2$, a high-pressure embossing section D and a drying and structure-fixing section E.

The continuously operating embossing press 10 according to the invention for the plant and for carrying out the method is distinguished by a continuously operating embossing press comprising endless flexible steel belts 5, 6 which transmit the compression pressure and temperature, pull the pressing stock through the press 10, are guided on an orbital path around the press table 2 and the press ram 3 by drive-controlled inlet drums 7, 8 and, at the end, via mechanically rigid semicircular arcs 25, 26 and are supported by friction-reducing elements relative to heated upper compression plates 11 on the press table 2 and the press ram 3, and by the fact that a structured belt made of woven metal wire which revolves with the upper steel belt is guided around the press ram and is arranged in such a way as to be deflected by dedicated deflection drums, the upper sliding support plates being of heatable design. For a better and more rapid build-up of steam pressure, it is expedient to seal the edge regions R of the structured belt with silicone where appropriate.

According to FIG. 1, the continuously operating embossing press 10 according to the invention for carrying out the method according to the invention comprises the press table 2, the movable press ram 3 and tension links 14 connecting them. To adjust the press nip 4, the press ram 3 is moved up and down by hydraulic piston-cylinder arrangements 15 and locked in the selected position.

Each of the steel belts 5 and 6 is guided around the press table 2 and the press ram 3 by two drive-controlled inlet drums 7 and 8. To reduce the friction between the compression plates 11, mounted on the press table 2 and the press ram 3, and the revolving steel belts 5 and 6, there is a—likewise revolving—carpet formed by friction-reducing elements, the bolster taking the form in the embodiment example of rolling rods 13. The rolling rods 13, the axes of which extend transversely to the direction of belt travel, are joined together on both longitudinal sides of the press by guide chains 12 with a predetermined pitch and are guided through the continuously operating embossing press 10 by the steel belts 5 and 6 as they roll along the compression plates 11 of the press ram 3 and the press table 2, on the one hand, and on the steel belts 5 and 6.

Figure 2:
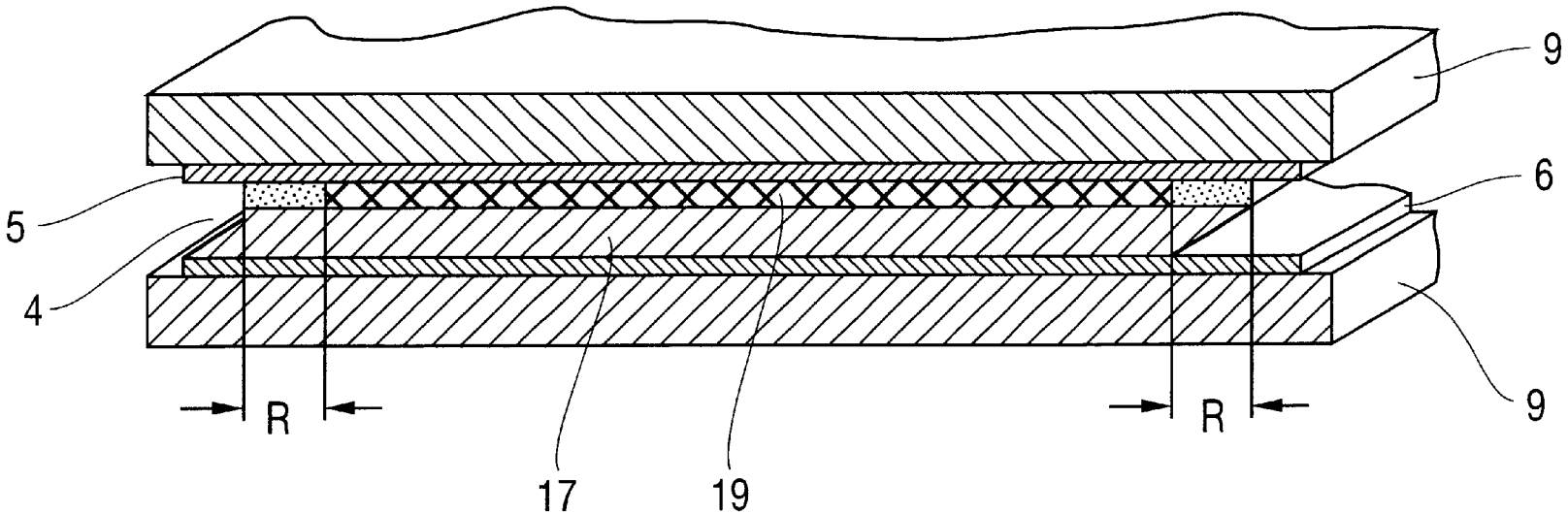
FIG. 2 shows a section a—a of FIG. 1 showing the pressing stock between the steel belts, the structured belt and the sliding support plates.
Figure 3:
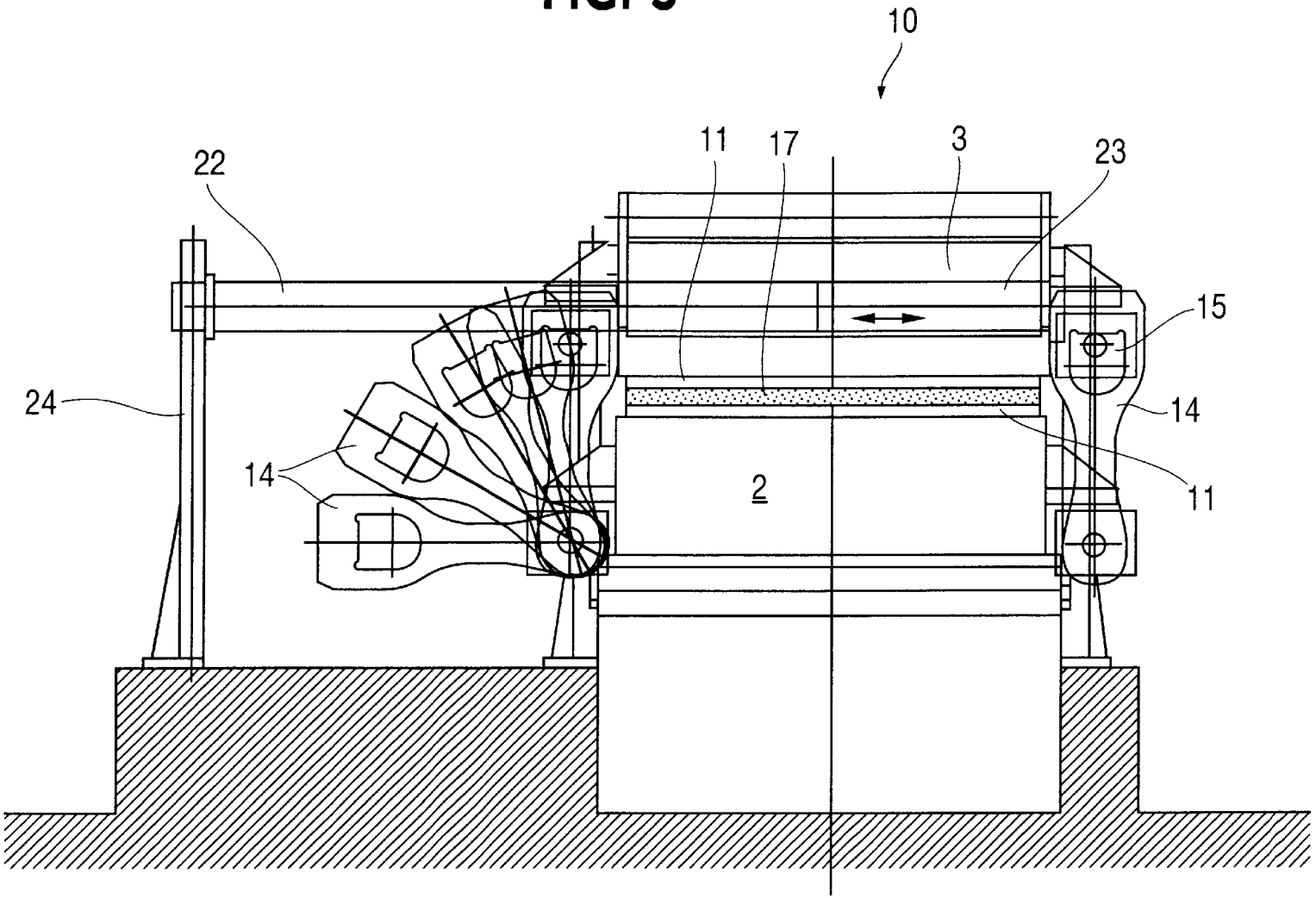
FIG. 3 shows the design of the continuously operating embossing press in a section b—b of FIG. 1 with swing-out tension links and telescopic tubes.

According to FIGS. 1 to 3, the plant is divided into five method sections:

| | |
|---|---|
| Section A | Section where the hot finished board 17 emerges from the continuously operating production press 1 up to where it enters the water spray hood 18, |
| Section B | Transfer section with application of water spray and direct entry to the upper inlet drum 7, |
| Section $C_1$ | Steam-pressure build-up section between the inlet drums 7 and 8 and the point where the rolling rods start to give support, |
| Section $C_2$ | Steam-pressure plasticizing section, |
| Section D | High-pressure embossing section and |
| Section E | Drying and structure-fixing section. |

In the rest of the description, the sections listed are referred to as zones A, B, $C_1$, $C_2$, D and E. As the diagram in FIG. 1 shows, the embossing pressures in zones $C_2$, D and E are transmitted to the board 17 from the top and bottom compression plates 11 by means of the rolling rods 13. The upper compression plates 11 in zones $C_1$, $C_2$, D and E are heated in order to bring about the plasticizing effect in the upper cover layer of the board 17 by the development of steam pressure and the compression pressure in zone $C_2$. The actual embossing takes place under extremely high mechanical pressure and extremely high steam pressure in zone D. In order to maintain the pattern accuracy of the embossed structure, the board 17 remains clamped in zone E under reduced pressure. At the end of zone E, the rolling rods 13 and steel belts 5 and 6 are guided back via mechanically rigid semicircular arcs 25 and 26. A simple mechanical and thus economical solution is thereby provided. The upper structured belt 19 is designed as a belt made of woven metal wire and is controlled independently of the upper steel belt in terms of its drive and belt path by the deflection drum 20 and guided on an orbital path at the end of the press ram 3 (which may also be referred to as an embossing ram) by the deflection pulley 21. The possibility of structuring the lower surface of the board 17 as well is not shown in the drawing for reasons of simplicity. As the surface water applied in the water spray hood 18 vaporizes, steam pressure builds up in zone $C_1$. This remains trapped in the inlet region of zone $C_1$, by sliding support plates 9. To avoid lateral steam leaks in the edge region R, the structured belt 19 can be sealed with silicone, for example. The compression pressure forces shown in FIG. 3 are produced between the lower press table 2 and the upper press ram 3 by lateral hydraulic actuators 15. To change the structured belt, in order, for example, to insert a different embossing pattern, the tension links 14 can advantageously be swung away to the side. Two telescopic tubes 22 are inserted horizontally in a stand-by position in the upper press structure to allow such a belt change-over . If the intention is to change the structured belt, the two telescopic tubes 22 are pulled laterally out of the opening 23 in the press ram 3 and pushed into a supporting structure 24 (coupled), so that the upper structured-belt arrangement is freely accessible for a belt changeover at the side.

The settings of the method parameters —embossing time, quantity of water spray, embossing temperature and embossing pressure-can be matched to one another by appropriate adjustment depending on the type of wood, particle geometry or fiber structure, desired embossing structure and pattern accuracy.

The method according to the invention is thus based on the following method parameters obtained by production trials with particle, fiber, OSB, MDF and plastic combination boards.

At the outlet of the continuously operating production press:

| | |
|---|---|
| Board surface temperature in Celsius | ≈150° to 170° |
| Board center temperature in Celsius | ≈115° to 120° |
| Density of the board in kg/m$^3$ | ≈600 to 800 |
| Moisture content in percent by weight | ≈6.5 to 7 |

In the region of the continuously operating embossing press:

| | |
|---|---|
| Quantity of water spray in g/m$^2$ | ≈115 to 225 |
| Water temperature in Celsius | ≈20° to < 100° |

In the region of zones $C_1$, and $C_2$:

| | |
|---|---|
| Steam temperature in Celsius | ≈120° to 200° |
| Quantity of steam introduced in g/m$^2$ | ≈75 to 120 |

-continued

| | |
|---|---|
| Compression and plasticizing pressure in N/mm$^2$ | ≈0.5 to 2 |
| Temperature of the structured belt surface in Celsius | ≈120° to 200° |
| Duration of plasticizing compression in seconds | ≈5 |
| Plasticizing depth in the cover layers of the board in mm | ≈3 |

In the region of zone D:

| | |
|---|---|
| Embossing pressure in N/mm$^2$ | ≈3.5 to 4 |
| Embossing time in seconds | ≈1 to 2 |
| Surface temperature of the board in Celsius | ≈120° to 200° |

In the region of zone E:

| | |
|---|---|
| Embossing pressure in N/mm$^2$ | ≈0.5 |
| Surface temperature of the board in Celsius | ≈120° to 200° |
| Drying time in seconds | ≈7 |
| Time to pass through the continuously operating embossing press in seconds | ≈12 to 13 |

At a throughput speed of 0.7 m/s, the resulting length L of the embossing press for these method parameters is as follows:

| | Length in m |
|---|---|
| For steam plasticization in zone $C_1$ and $C_2$ at a throughput speed of v ≈ 0.7 m/s | 3.5 |
| For the embossing zone D | 0.7 to 1.4 |
| For the drying and structure-fixing zone E | 4.9 |
| Total length L of embossing press: | 9–10 |

The embossing times required for OSB boards, for example, determine the lengths of zones $C_2$, D and E according to the maximum production rates. This means that, for optimum production the continuously operating embossing press 10 runs synchronously with the continuously operating production press 1. If longer embossing times are required, this can be effected by means of the throughput speed.

To allow uniform distribution of the water over the surfaces of the boards 17, spray nozzles are arranged in a uniformly distributed manner in one plane in the water spray hood 18. Depending on the absorption characteristics of the surface of the pressing stock, a quantity in a range of from 112.5 g/m$^2$to about 225 g/m$^2$is supplied by way of pumps. It is preferably preheated to a temperature below the vaporization temperature <100° Celsius in order to avoid unnecessarily removing heat from the hot board 17. The optimum embossing temperature is about 200° Celsius. In the case of soft woods, lower temperatures of up to 120° Celsius may also be sufficient. The temperature profile at the surface of the board made of compressed material in zones A to E is illustrated in FIG. 1. The steam pressure, which correlates approximately with this, is illustrated in the trend curve g. The pressure profile illustrated for zones $C_2$, D and E represents optimum design parameters for a continuous method, when using OSB boards for example. Different values can be set in zones $C_2$, D and E depending on the surface behavior of the pressing stock, as shown by way of example in pressure curve h. Given the higher quantity of water spray required for plasticization, steam pressure relief i in zone E may be advantageous, for example, but the contact of the structured belt being maintained however to fix the embossed pattern. For other types of wood and particles, the lengths of zones $C_2$, D and E plotted can be configured accordingly. However, the basic concept of the association between the zones remains unaltered.

If production is to be switched over seamlessly and abruptly from a structured surface to a smooth surface of the board 17 at full production speed, the process is switched as follows: the supply of water spray is switched off. The transition line from a wet surface is recorded numerically as the board 17 passes through. As this wet/dry line passes through, the following zones, namely the vaporization and plasticizing zone $C_1$and $C_2$, the high-pressure embossing zone D and post-drying zone E, are depressurized numerically and released (raised) out of contact with the board 17. If there is a lengthy changeover of production from structured to smooth, the upper heating in zones $C_1$, $C_2$, D and E is switched off.

To introduce a change from smooth to structured, the process chain is activated as follows. The water spray is switched on. The transition line from a dry to a wet surface is again recorded numerically, so that the following zones are introduced accordingly and activated in terms of pressure.

The release stroke for the upper heated embossing section L relative to the board 17 is about 50 to 100 mm. To compensate for the radiant heat with the imprint section released, a limited quantity of water is sprayed onto the surface of the board 17 by means of spraying zone B until it has cooled to room temperature or fallen below the temperature where this radiant heat has a harmful effect, e.g., one-sided drying out of the board 17, with the result that a state of equilibrium between the moisture content of the upper and lower cover layer of the board 17 is deliberately maintained during this cooling time for the upper embossing section L.

The priority document here, German application 198 36 823.2 filed Aug. 13, 1998, is hereby incorporated by reference.

What is claimed is:

1. A method for producing embossed boards in which a continuously operating production press compresses and cures a mat of pressing stock with an application of pressure and heat thus forming a board, comprising the steps of:

conveying the board from the continuously operating production press through a discharge section to a transfer section;

cooling an outer surface of the board at the transfer section by spraying the outer surface with water at a rate in a range from 112.5 g/m$^2$ to 225 g/m$^2$;

transferring the board from the transfer section to a continuously operating embossing press including a structured belt, contacting the outer surface of the board with the structured belt, and raising steam pressure on the belt in a steam pressure build-up section of the continuously operating embossing press;

conveying the board to a steam pressure plasticizing section of the continuously operating embossing press, and subjecting the board to an increasing pressure and a rising temperature;

conveying the board to a high-pressure embossing section of the continuously operating embossing press and subjecting the board to an embossing pressure and a plasticizing temperature; and passing the board to a drying and structure fixing section of the continuously operating embossing press, subjecting the board to a falling embossing pressure and temperature, thus forming in the outer surface of the board a permanently embossed pattern.

2. The method of claim 1, wherein the cooling step includes spraying the board with water having a temperature of 20 degrees Celsius to less than 100 degrees Celsius.

3. The method of claim 2, wherein the cooling step includes cooling the outer surface of the board to a temperature of less than 110 degrees Celsius.

4. The method of claim 1, wherein the step of raising steam pressure in the steam pressure build-up section includes raising the steam-pressure in the range from 0.5 N/mm$^2$ to 2 N/mm$^2$.

5. The method of claim 1, wherein the board is subjected to the embossing pressure in a range from 3.5 N/mm$^2$ to 4 N/mm$^2$.

6. The method of claim 1, wherein the board is subjected to the rising temperature of less than 200 degrees Celsius.

7. The method of claim 1, wherein the board is subjected to the falling embossing pressure of 0.5 N/mm$^2$ and the falling temperature of 120 degrees Celsius.

8. The method of claim 1, wherein the board is an OSB board and wherein passing the OSB board from the transfer section through the end of the drying and structure fixing section takes approximately 13 seconds.

9. The method of claim 1, wherein the steam pressure produced in the steam pressure build-up section is removed, condensed, and then reused as water in the transfer section for application to the outer surface of the board.

* * * * *